US009257244B2

(12) United States Patent
Dai

(10) Patent No.: US 9,257,244 B2
(45) Date of Patent: Feb. 9, 2016

(54) ELECTRONIC DEVICE WITH POWER SWITCH

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Bin Dai, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 156 days.

(21) Appl. No.: 13/947,102

(22) Filed: Jul. 22, 2013

(65) Prior Publication Data

US 2014/0027258 A1 Jan. 30, 2014

(30) Foreign Application Priority Data

Jul. 27, 2012 (CN) ..... 2012 1 0262907

(51) Int. Cl.
*H01H 13/10* (2006.01)
*H01H 13/14* (2006.01)
*H01H 13/20* (2006.01)

(52) U.S. Cl.
CPC ..... *H01H 13/10* (2013.01); *H01H 13/14* (2013.01); *H01H 13/20* (2013.01)

(58) Field of Classification Search
CPC ..... H01H 13/02; H01H 9/00; H02B 11/133
USPC ..... 200/512, 51.16
See application file for complete search history.

(56) References Cited

U.S. PATENT DOCUMENTS

| | | | | |
|---|---|---|---|---|
| 6,667,447 | B2 * | 12/2003 | Liu et al. | 200/5 R |
| 7,253,720 | B2 * | 8/2007 | Beckwith et al. | 340/330 |
| 7,332,681 | B2 * | 2/2008 | Wohlfart | 200/5 A |
| 7,683,275 | B2 * | 3/2010 | Moore et al. | 200/17 R |
| 8,071,897 | B2 * | 12/2011 | Chiu | 200/5 A |
| 2006/0214778 | A1 | 9/2006 | Beckwith et al. | |
| 2011/0094866 | A1 * | 4/2011 | Dai | 200/345 |

FOREIGN PATENT DOCUMENTS

| | | | |
|---|---|---|---|
| CN | 102044364 | A | 5/2011 |
| CN | 102403147 | A | 4/2012 |
| CN | 102568890 | A | 7/2012 |

* cited by examiner

*Primary Examiner* — Edwin A. Leon
*Assistant Examiner* — Iman Malakooti
(74) *Attorney, Agent, or Firm* — Novak Druce Connolly Bove + Quigg LLP

(57) ABSTRACT

A power switch includes an operating button, an elastic member, a printed circuit board, a support member, and a fixing module. The operating button includes a connecting portion. The elastic member includes a fixing portion and an elastic portion. The printed circuit board includes a main body and a contacting element. The support member includes a base portion and a receiving portion perpendicularly extending from the base portion, and the base portion defines a hole communicating with the receiving portion. The fixing module includes a cover and a contacting member formed on the cover. The connecting portion of the operating button is fixed to the main body and is received in the hole of the support member and the receiving portion. The fixing portion of the elastic member is sandwiched between the connecting portion of the operating button and the main body.

13 Claims, 4 Drawing Sheets

ELECTRONIC DEVICE WITH POWER SWITCH

BACKGROUND

1. Technical Field

This disclosure generally relates to electronic devices, and particularly, to an electronic device with a power switch.

2. Description of Related Art

Many electronic devices have a power switch for turning the electronic device on/off. Such electronic devices include a housing defining a receiving hole, and the power switch is received in the receiving hole. The power switch includes an operating button, a support member, a printed circuit board, and an elastic piece which is installed between the operating button and the printed circuit board. When the operating button is pressed to contact the electrical contacts of the printed circuit board, the electronic device turns on. When assembling the power switch in the housing, the operating button is inserted into the receiving hole, and the elastic piece is fixed to a surface of the operating button adjacent to the printed circuit board, and the support member is fixed to the housing, such that the elastic piece is located between the operating button and the printed circuit board and a space is reserved for allowing deformation of the elastic piece. However, in the assembly process, a technician must manually align the operating button with the elastic piece, which is time consuming and often produces imprecise results.

Therefore, there is room for improvement in the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views. Wherever possible, the same reference numerals are used throughout the drawings to refer to the same or like elements of an embodiment.

DETAILED DESCRIPTION

Figure 1:
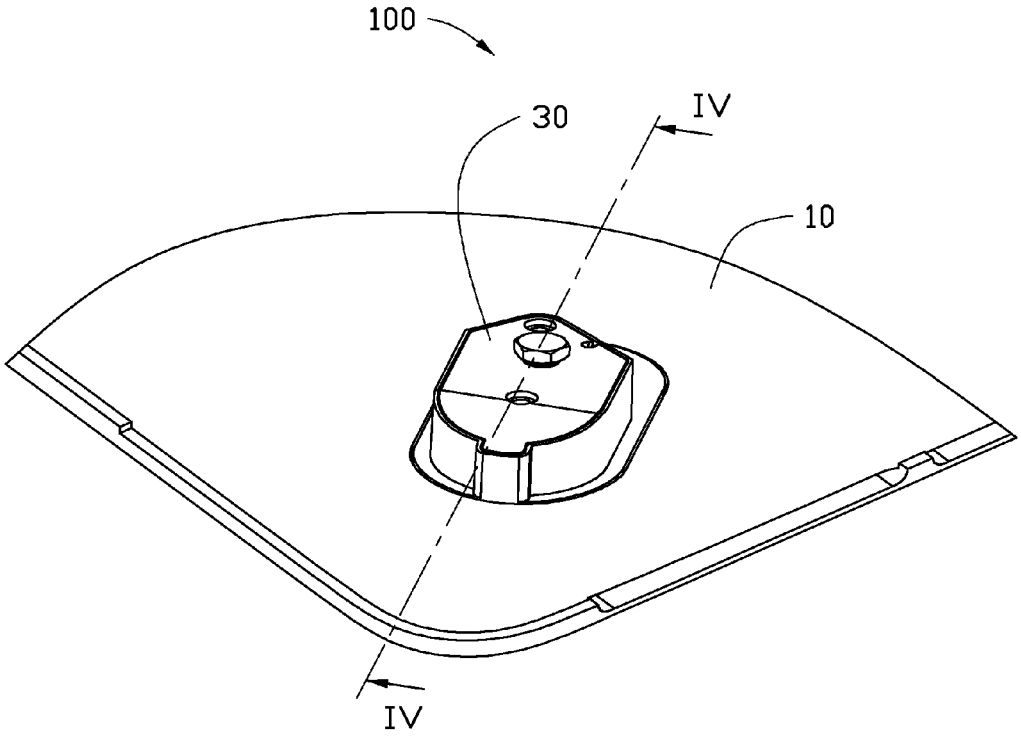
FIG. 1 is a partial, isometric view of an embodiment of an electronic device.

Referring to FIG. 1, an embodiment of an electronic device 100 includes a housing 10 and a power switch 30 installed and positioned on the housing 10. The electronic device 100 includes various modules for performing specific functions and features. However, for the sake of simplicity, only the module and components related to the power switch 30 is described herein.

Figure 2:
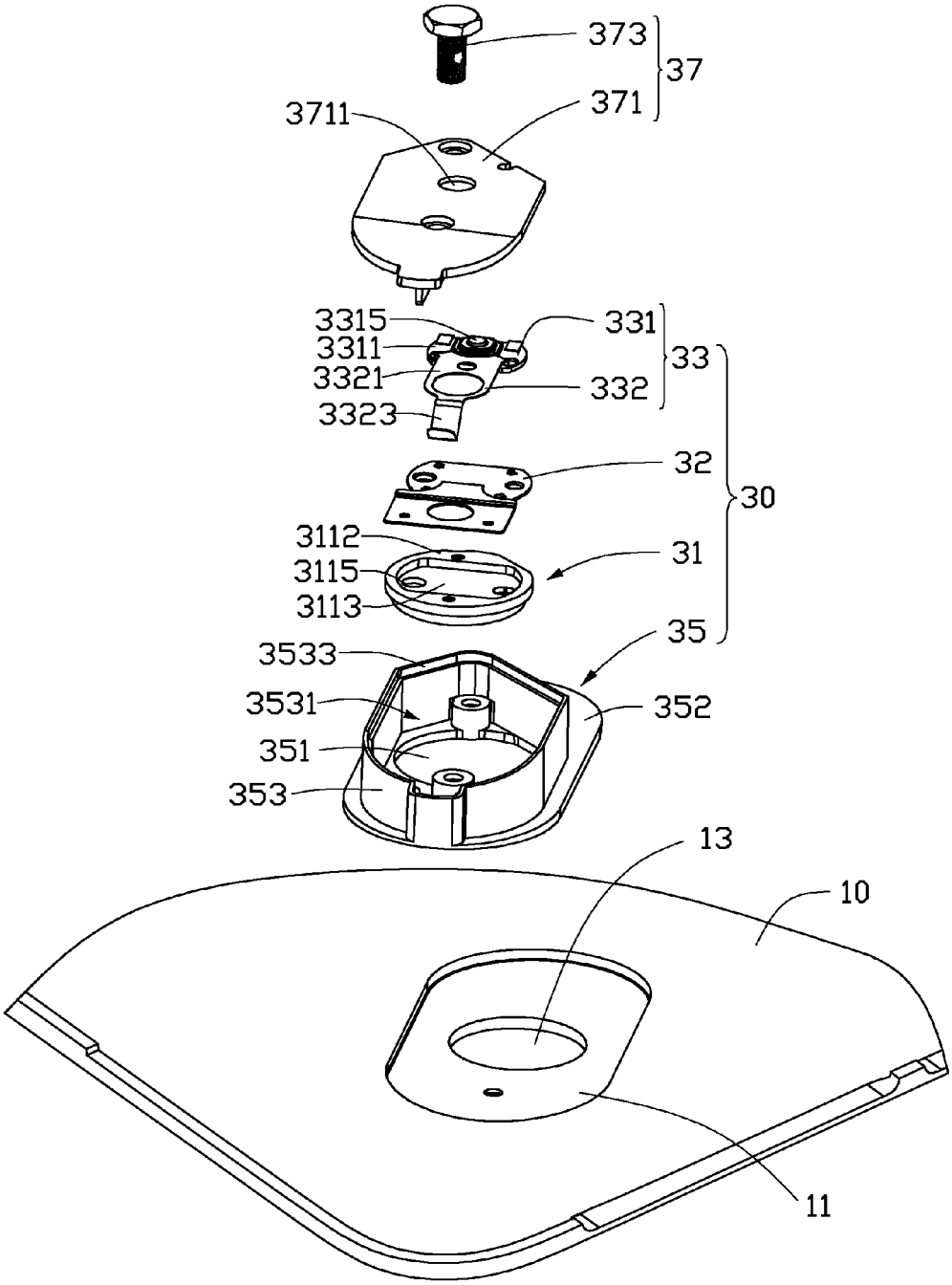
FIG. 2 is an exploded, partial isometric view of the electronic device of FIG. 1.

Referring to FIG. 2, the housing 10 includes an assembly portion 11 and a assembly hole 13 defined in the middle portion of the assembly portion 11. In the illustrated embodiment, the assembly portion 11 is substantially an elliptical depression defined in an inner surface of the housing 10 around the assembly hole 13. In alternative embodiments, the assembly portion 11 may be of other shapes, such as rectangular.

Figure 3:
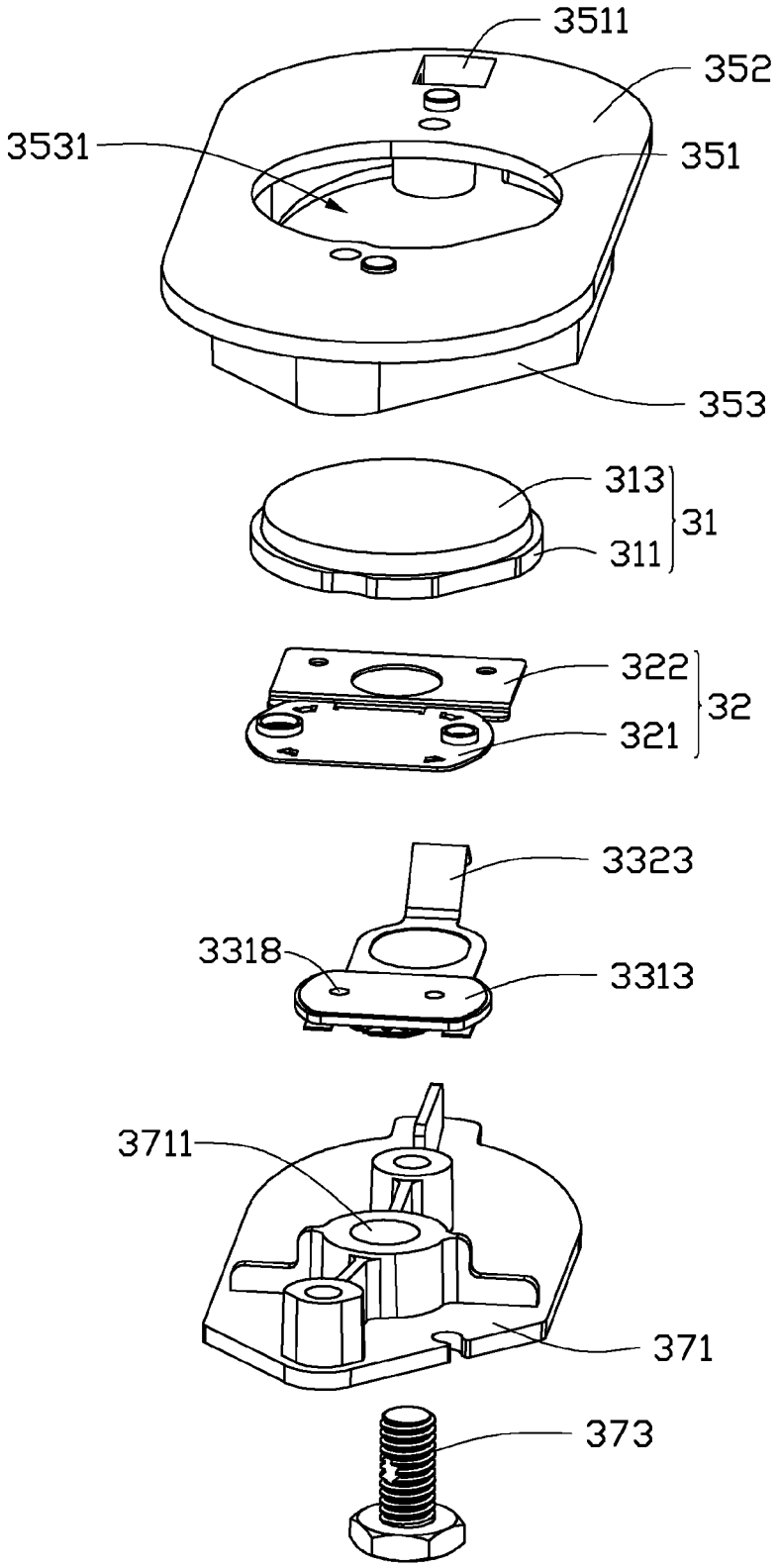
FIG. 3 is similar to FIG. 2, but viewed from another aspect.
Figure 4:
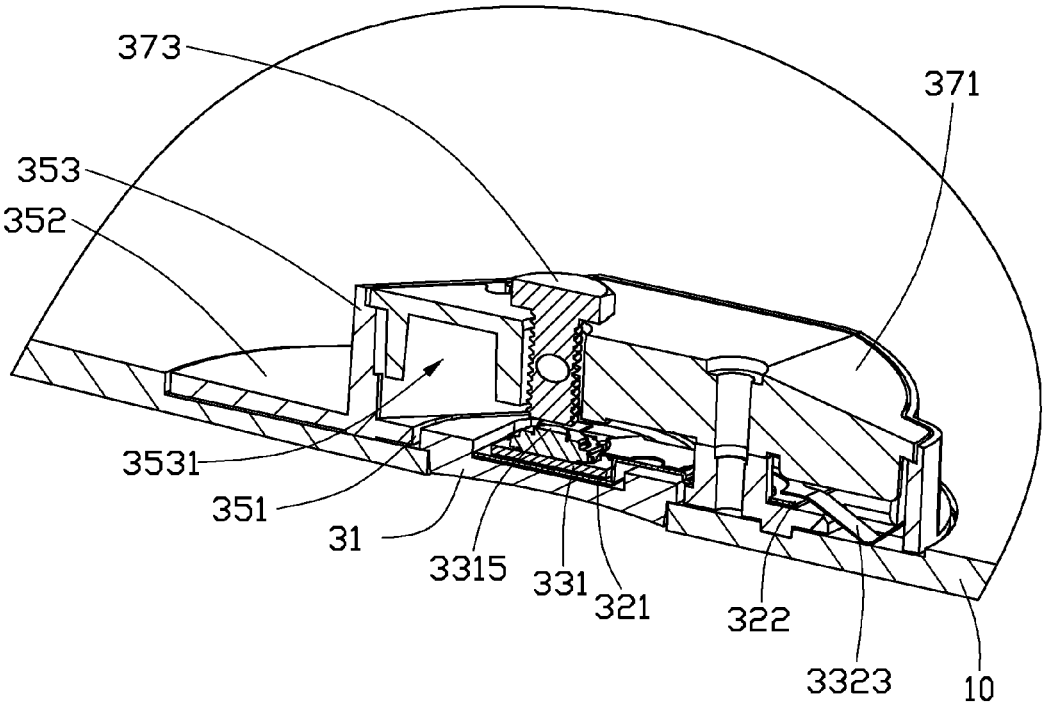
FIG. 4 is a cross-sectional view of the electronic device of FIG. 1 taken along line IV-IV.

Referring to FIGS. 3 and 4, the power switch 30 includes an operating button 31, an elastic member 32, a printed circuit board 33, a support member 35, and a fixing module 37. The support member 35 is fixed to the housing 10. The operating button 31, the elastic member 32, and the printed circuit board 33 are assembled in the support member 35. The fixing module 37 is positioned to cover the support member 35 to fix the operating button 31, the elastic member 32, and the printed circuit board 33 in place.

The operating button 31 includes a pressing portion 313 and a connecting portion 311 coaxially positioned on the pressing portion 313. The connecting portion 311 is assembled in the assembly portion 11 of the housing 10. The pressing portion 313 is received in the assembly hole 13. The pressing portion 313 has an inner surface 3112 and defines an assembly groove 3113 in the inner surface 3112. Two positioning grooves 3115 are defined in the bottom surface of the assembly groove 3113.

The elastic member 32 includes a fixing portion 321 and an elastic portion 322 extending from an end of the fixing portion 321. The fixing portion 321 is fixed in the assembly groove 3113 of the operating button 31. The elastic portion 322 extends out of the assembly groove 3113. In the illustrated embodiment, the elastic portion 322 is made of stainless steel.

The printed circuit board 33 includes a main body 331 and an elastic arm 332 extending from an end of the main body 331. The main body 331 includes a first surface 3311 and a second surface 3313 opposite to the first surface 3311. The printed circuit board 33 further includes a contacting element 3315 located on the first surface 3311 thereof. The second surface 3313 forms two positioning protrusions 3318 corresponding to the two positioning grooves 3115 of the operating button 31. The elastic arm 332 includes a connecting portion 3321 fixed on the first surface 3311 and a resisting portion 3323 extending from an end of the connecting portion 3321 away from the main body 331. The resisting portion 3323 is bent towards the inner surface 3112 of the operating button 31. The second surface 3313 is fixed to the assembly groove 3113 of the operating button 31. Thus, the fixing portion 321 is sandwiched between the main body 331 of the printed circuit board 33 and the connecting portion 311 of the operating button 31. The two positioning protrusions 3318 pass through the fixing portion 321, and are latched in the two positioning grooves 3115 correspondingly. In the illustrated embodiment, the resisting portion 3323 is substantially V-shaped and resists the housing 10.

The support member 35 includes a base portion 352 and a receiving portion 353 perpendicularly extending from the base portion 352. The base portion 352 of the support member 35 is substantially a flat board and has the same shape as the assembly portion 11 of the housing, and is received in the assembly portion 11. The base portion 352 and the receiving portion 353 cooperatively form a receiving space 3531 for receiving the operating button 31, the elastic member 32, and the printed circuit board 33. The base portion 352 defines a hole 351 in the middle portion thereof communicating with the receiving space 3531 for receiving the pressing portion 313 of the operating button 31. The receiving portion 353 defines a groove 3533 in an end thereof away from the base portion 352.

The fixing module 37 includes a cover 371 and a contacting member 373. The cover 371 is assembled in the groove 3533 of the support member 35. The cover 371 defines a fixing hole 3711 for fixing the contacting member 373 in place. In the illustrated embodiment, the contacting member 373 is a fastener, the fixing hole 3711 is a threaded hole, and the contacting member 373 (fastener) is screwed into the threaded hole.

In the illustrated embodiment, the contacting element 3315 is a battery. When an external force is applied to press the contacting element 3315 to contact the contacting member 373, the contacting element 3315 provides power for the printed circuit board 33 to generate a control signal to the control circuit of the printed circuit board 33. The control circuit is capable of turning the electronic device 100 on/off via the control signal.

In alternative embodiments, the contacting member 373 may be a protrusion protruding out of the inner surface of the cover 371 opposite to the contacting element 3315.

In assembly, the fixing portion 321 of the elastic member 32 is fixed in the assembly groove 3113 of the operating button 31. The main body 331 of the printed circuit board 33 is positioned on the fixing portion 321. The two positioning protrusions 3318 of the main body 331 extend through the fixing portion 321 and latch in the two positioning grooves 3115 correspondingly to fix the printed circuit board 33 to the operating button 31. The connecting portion 311 of the operating button 31 is received in the hole 351 of the supporting member 35. The elastic portion 322 of the elastic member 32 is received in the receiving space 3531 and is fixed to the base portion 352. The cover 371 is assembled in the groove 3533 of the support member 35, and the contacting member 373 is fixed in the fixing hole 3711 and is located opposite to the contacting element 3315.

The fixing portion 321 of the elastic member 32 is sandwiched between the connecting portion 311 and the main body 331. The elastic portion 322 is fixed to the base portion 352 of the support member 35 to generate an elastic force to drive the operating button 31 and the printed circuit board 33 to go back to their original positions. As the elastic member 32, the operating button 31, and the printed circuit board 33 are fixed together, the power switch 30 can be more precisely assembled and assembled in less time.

The present embodiments and their advantages will be understood from the foregoing description, and it will be apparent that various changes may be made thereto without departing from the spirit and scope of the embodiments or sacrificing all of its material advantages.

What is claimed is:

1. A power switch comprising:

an operating button comprising a connecting portion;

an elastic member comprising a fixing portion and an elastic portion extending from an end of the fixing portion;

a printed circuit board comprising a main body comprising a first surface and a second surface opposite to the first surface and a contacting element located on the first surface thereof;

a support member comprising a base portion and a receiving portion perpendicularly extending from the base portion, the base portion defining a hole communicating with the receiving portion; and a fixing module comprising a cover and a contacting member formed on the cover, wherein the connecting portion of the operating button is fixed to the second surface of the printed circuit board and is received in the hole of the support member and the receiving portion of the support member, the fixing portion of the elastic member is sandwiched and resists between the connecting portion and the main body, an end of the elastic portion away from the fixing portion is fixed to the base portion, the cover is covered on the support member with the contacting member being located opposite to the contacting element, when an external force is applied to press the operating button, the contacting element contacts the contacting member with the elastic portion deformed to generate an elastic force to drive the operating button and the printed circuit board to go back to their original positions;

wherein the operating button further comprises a pressing portion, and the connecting portion is configured around the pressing portion, the pressing portion has an inner surface and defines an assembly groove in the inner surface thereof, and the fixing portion of the elastic member is fixed in the assembly groove; and wherein two positioning grooves are defined in the bottom surface of the assembly groove, the second surface of the main body of the printed circuit board forms two positioning protrusions corresponding to the two positioning grooves of the operating button, and the two positioning protrusions pass through the fixing portion and are latched in the two positioning grooves correspondingly to fix the printed circuit board to the operating button.

2. The power switch of claim 1, wherein the receiving portion defines a groove in an end of the receiving portion away from the base portion, and the cover is assembled in the groove.

3. The power switch of claim 2, wherein the cover defines a fixing hole, and the contacting member is fixed in the fixing hole.

4. The power switch of claim 1, wherein the printed circuit board further comprises an elastic arm extending from an end of the main body, the elastic arm comprises a connecting portion fixed on the first surface of the main body and a resisting portion extending from an end of the connecting portion away from the main body, and the resisting portion bends towards the inner surface of the operating button.

5. The power switch of claim 1, wherein the resisting portion is substantially V-shaped.

6. The power switch of claim 1, wherein the contacting element is a battery.

7. An electronic device, comprising:

a housing; and a power switch installed and positioned on the housing, the power switch comprising:

an operating button comprising a connecting portion;

an elastic member comprising a fixing portion and an elastic portion extending from an end of the fixing portion;

a printed circuit board comprising a main body comprising a first surface and a second surface opposite to the first surface and a contacting element located on the first surface thereof;

a support member comprising a base portion and a receiving portion perpendicularly extending from the base portion, the base portion defining a hole communicating with the receiving portion; and a fixing module comprising a cover and a contacting member formed on the cover, wherein the connecting portion of the operating button is fixed to the second surface and is received in the hole of the support member and the receiving portion of the support member, the fixing portion of the elastic member is sandwiched and resists between the connecting portion and the main body, an end of the elastic portion away from the fixing portion is fixed to the base portion, the cover is covered on the support member with the contacting member being located opposite to the contacting element, when an external force is applied to press the operating button, the contacting element contacts the contacting member with the elastic portion deformed to generate an elastic force to drive the operating button and the printed circuit board to go back to their original positions;

wherein the operating button further comprises a pressing portion, and the connecting portion is configured around the pressing portion, the pressing portion has an inner surface and defines an assembly groove in the inner surface thereof, and the fixing portion of the elastic member is fixed in the assembly groove; and wherein two positioning grooves are defined in the bottom surface of the assembly groove, the second surface of the main body of the printed circuit board forms two positioning protrusions corresponding to the two positioning grooves of the operating button, and the two positioning protrusions pass through the fixing portion and are latched in the two positioning grooves correspondingly to fix the printed circuit board to the operating button.

8. The electronic device of claim 7, wherein the housing comprises an assembly portion and an assembly hole defined in the assembly portion, and the power switch is installed in the assembly hole.

9. The electronic device of claim 7, wherein the receiving portion defines a groove in an end of the receiving portion away from the base portion, and the cover is assembled in the groove.

10. The electronic device of claim 9, wherein the cover defines a fixing hole in which the contacting member fixed in.

11. The electronic device of claim 7, wherein the printed circuit board further comprises an elastic arm extending from an end of the main body, the elastic arm comprises a connecting portion fixed on the first surface of the main body and a resisting portion extending from an end of the connecting portion away from the main body, and the resisting portion bends towards the inner surface of the operating button.

12. The electronic device of claim 7, wherein the resisting portion is substantially V-shaped.

13. The electronic device of claim 7, wherein the contacting element is a battery.

* * * * *